US005584769A

United States Patent [19]

Sundin

[11] Patent Number: 5,584,769

[45] Date of Patent: Dec. 17, 1996

[54] TWO-FACED GOLF CLUB

[76] Inventor: Donald C. Sundin, 127 Maple Ave., Smithtown, N.Y. 11787

[21] Appl. No.: 434,385

[22] Filed: May 3, 1995

[51] Int. Cl.[6] ..... A63B 53/04

[52] U.S. Cl. ..... 473/325

[58] Field of Search ..... 273/168, 77 R, 273/167 R, 167 A, 167 G, 80 C, 80 D, 80.1, 80.2, 80.7; 473/325

[56] References Cited

U.S. PATENT DOCUMENTS

| | | | |
|---|---|---|---|
| D. 346,191 | 4/1994 | Bryant | D21/214 |
| 2,472,312 | 6/1949 | Parrish | 273/77 R |
| 3,837,653 | 9/1974 | Fox et al. | 273/168 X |
| 4,522,405 | 6/1985 | Clawges | 273/167 A |
| 4,537,403 | 8/1985 | Farina | 273/168 X |
| 4,881,737 | 11/1989 | Mullins | 273/80 A |
| 5,176,379 | 1/1993 | Reinberg | 273/168 X |
| 5,458,335 | 10/1995 | Hattori | 273/168 |

*Primary Examiner*—William H. Grieb
*Attorney, Agent, or Firm*—Galgano & Burke

[57] ABSTRACT

A two-faced golf club for right-handed or left-handed golfers having a vertical shaft and putter blade with a top surface, a bottom surface, a putting face, a chipping face, and a front surface. The top surface and the putting face meet at an angle of about ninety degrees and the top surface and the chipping face meet at an angle of at least one hundred and thirty degrees relative to the vertical shaft. The vertical shaft meets the blade at a center point on the top surface of the putter blade allowing versatility for both right-handed and left-handed golfers. The bottom surfaces of the golf club are preferably rounded to prevent "stubbing" with the ground during play.

13 Claims, 2 Drawing Sheets

TWO-FACED GOLF CLUB

The present invention relates to golf clubs capable of being used by both right-handed and left-handed golfers. More particularly, the present invention relates to a versatile golf putter comprising a putting face and a chipping face which does not require interchanging or reversing of parts for alternate use by left-handed or right-handed golfers.

BACKGROUND

Several innovations for golf putters have been developed in the past. For example, U.S. Pat. No. 2,472,312 to Parrish describes a putter with a striking edge located at a distance from the ground greater than that of the radius of a normal sized golf ball, such that, when contacted by the striking edge, the ball will spin forward creating top spin. U.S. Pat. No. 4,522,405 to Clawges discloses a golf putter having a single putter face designed with a curved bottom to reduce the chances of stubbing the putter on the ground when stroking the ball. In addition, U.S. Pat. No. 4,881,737 to Mullins relates to a putter having a vertical shaft centrally located within the head. The putter is usable for both right and left-handed golfers but requires unscrewing the head and interchanging parts to accomplish the transition. U.S. Pat. No. Des. 346,191 to Bryant relates to a particular design of a golf club putter showing an angularly disposed two-faced golf club.

None of the prior art devices disclose a two-faced golf putter whereby a vertical shaft is centrally affixed to a putter blade to inherently facilitate adaptable use for both left-handed and right-handed golfers and designed to prevent stubbing with the ground surface during play.

SUMMARY OF THE INVENTION

Accordingly, it is an object of the present invention to provide a novel two-faced golf putter useable by both left-handed and right handed golfers.

It is another object of the present invention to provide a two-faced golf putter which is economical to manufacture, durable and of relatively simple construction and design.

More particularly, it is an object of the present invention to provide a two-faced golf putter which has at least one rounded bottom edge to prevent the golf putter from stubbing during play.

Additionally, it is an object of the present invention to provide a two-faced golf putter which is easily adaptable for use by both right-handed and left-handed golfers. More particularly, it is another object of the present invention to provide a golf putter which can be adapted for either right or left-handed use without the need to interchange parts.

Another object of the present invention is to provide a two-faced golf putter which has an angled face on one side for alternate use as an iron or a chipping wedge depending on the degree of the face as manufactured.

DETAILED DESCRIPTION

In accordance with one embodiment the present invention, a two-faced golf putter for right-handed or left-handed golfers, comprises a generally rectangularly faced putting blade having a top surface, a bottom surface, a putting face, a chipping face, and a front surface. The putting blade comprises a first common edge between the top surface and the putting face which meet an angle of at least ninety degrees and a rear midpoint located at the center of the first common edge. The putting blade also comprises a second common edge located between the top surface and the front surface having a side midpoint located at the center of the second common edge. A central point is located on the top surface of the putting blade and is defined by and located at an intersection between a perpendicular line drawn from the rear midpoint across the top surface and a perpendicular line drawn from the side midpoint across the top surface. A vertically disposed shaft is right angularly attached at the central point of the top surface.

The putting blade also comprises a third common edge located between the top surface and the chipping face. The chipping face is angularly disposed at an outside angle of at least 130 degrees relative to the vertical shaft. Forth and fifth common edges are located between the bottom surface and the putting face and the bottom face and the chipping face, respectively, both edges having a generally rounded disposition.

Preferably, the angle of the chipping face of the golf putter can be manufactured anywhere between 130 and 170 degrees relative to the vertical shaft depending upon the needs of an individual golfer. Advantageously, the chipping face of the golf putter is designed at an angle closer to 160 degrees for use when chipping beside a putting green. Most desirably, the bottom edge of the chipping face is substantially rounded to prevent stubbing when "cocking" the golf putter or "stroking" the golf ball.

Preferably, the putting face of the golf putter is disposed at approximately 90 degrees relative to the vertical shaft. Advantageously, the bottom edge of the putting face is rounded to prevent stubbing when "cocking" or "stroking" the golf ball.

In a particular preferred embodiment, the circumference of the vertical shaft of the putter is enlarged to promote better stability and control of the putter. Preferably, the shaft is enlarged to have a diameter of at least one inch. In a further embodiment of the golf putter, the vertical shaft is removably attached to the putting blade. In another further preferred embodiment, a putter grip is circumferentially attached to the vertical shaft of the golf putter.

Figure 1:
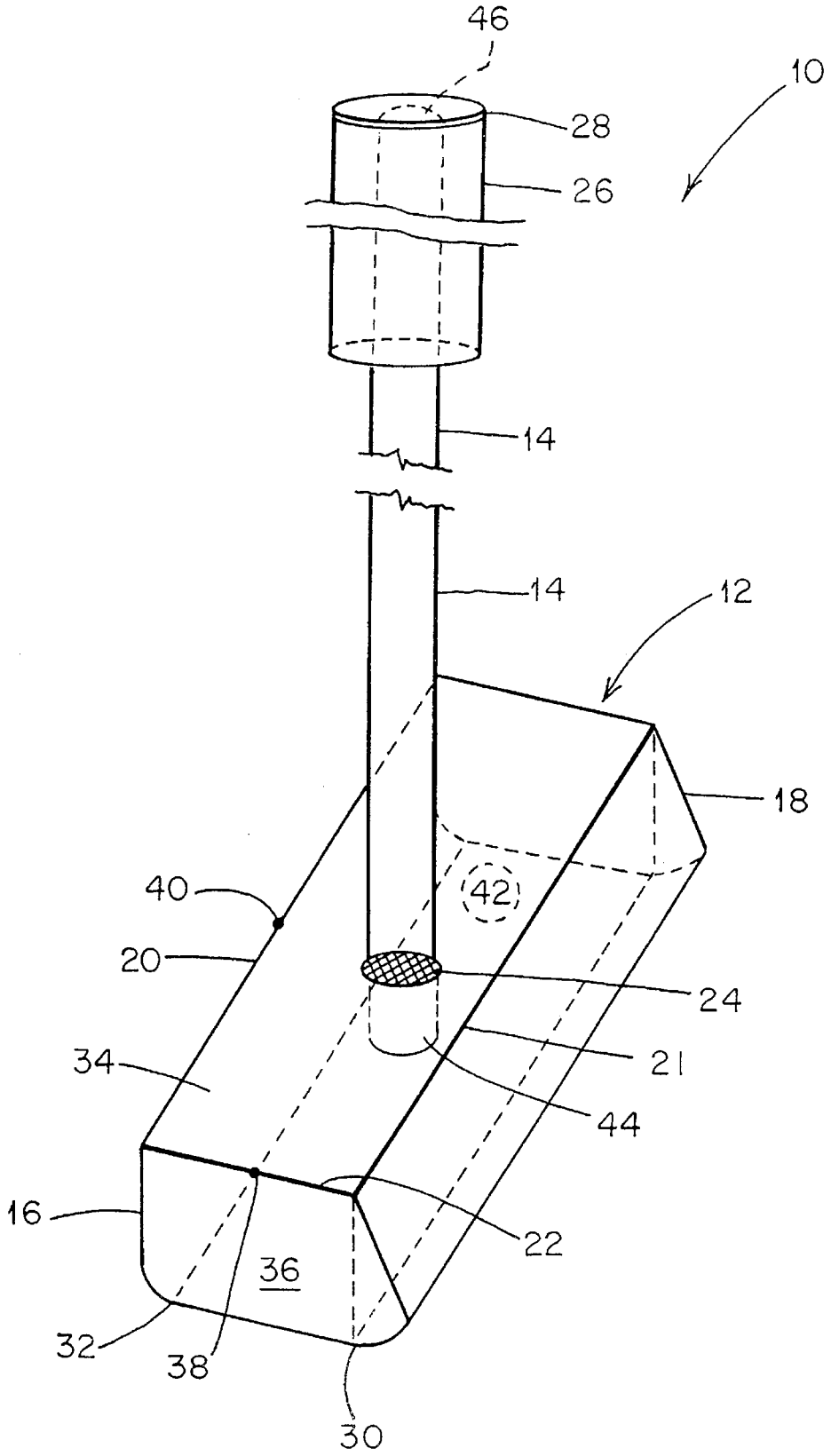
FIG. 1 is a perspective view in part section showing the two-faced golf putter with putting face and chipping face.

Turning now in detail to the appended drawings, and in particular FIG. 1, therein illustrated is a novel two-faced golf putter, according to one embodiment of the present invention, generally designated by reference numeral 10. Putter 10 comprises blade 12, configured and dimensioned to have putting face 16 and chipping face 18, and generally tubular vertical shaft 14. Putting face 16 is generally used to roll a golf ball along a putting green and chipping face 18 is generally used to lift or jump a golf ball over an obstacle or uneven ground. In particular, FIG. 1 shows shaft 14 right angularly affixed at central point 24 to top face 34 of blade 12. Second end 44 of shaft 14 is centrally located at central point 24 so as to easily adapt for right-handed or left-handed golfers and, advantageously, can be used efficiently in either position. Preferably, second end 44 of shaft 14 is removably attached to the blade 12 and extends substantially through top face 34 of blade 12 to promote stability. In particular preferred embodiments, shaft 14 is collapsible and/or telescopic to promote easy storage and more flexibility during play. In another preferred embodiment, shaft 14 comprises several interlocking elements which allow for even more flexibility.

Figure 2:
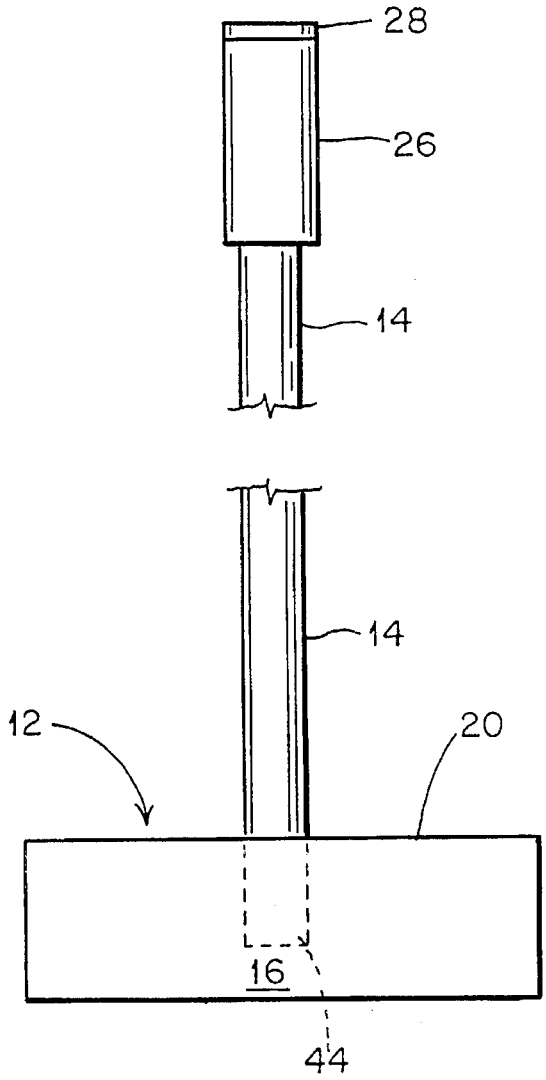
FIG. 2 is a front view in part section showing the putter blade with phantom view of vertical shaft centrally affixed to putting blade and extending therethrough.
Figure 3:
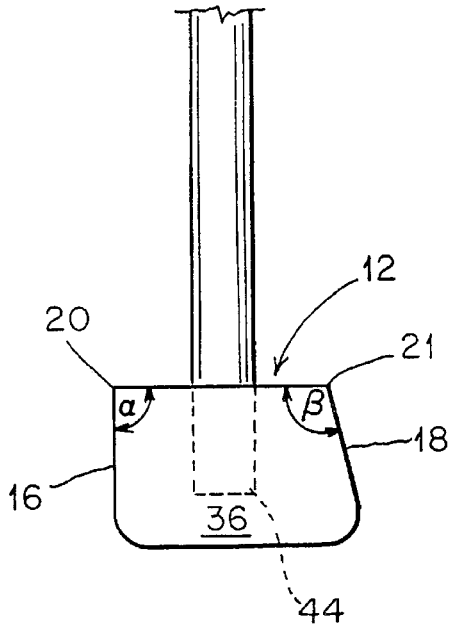
FIG. 3 is a side elevational view in part section illustrating putting blade with putting face and chipping face and phantom view representation of vertical shaft extending therethrough.

As shown in FIGS. 1–3, putter blade 12 is preferably rectangular and includes top surface 34 and front surface 36 and is defined by several common edges; first common edge 20, second common edge 22, third common edge 21, forth common edge 32, and fifth common edge 30.

First common edge 20 joins top surface 34 and putting face 16 and is generally disposed at an angle of at least 90 degrees (α). Rear midpoint 40 is located at the center of first common edge 20. Second common edge 22 joins top surface 34 and front surface 36 and, likewise, side midpoint 38 is located at its center. Central point 24 is defined by and located at an intersection between a perpendicular line drawn from rear midpoint 40 across top surface 34 and a perpendicular line drawn from side midpoint 38 across top surface 34.

As seen most clearly in FIG. 3, third common edge 21 joins top surface 34 with chipping face 18 and is generally disposed at an angle of at least 130 degrees (β) relative to shaft 14 (depending upon the individual needs of each golfer). Fourth common edge 32 joins bottom surface 42 and putting face 16 and is generally rounded to prevent stubbing the blade 12 on the ground surface during play. Fifth common edge 30 joins bottom surface 42 with chipping face 18 and, likewise, is generally rounded to prevent stubbing.

FIGS. 1 and 2 also illustrate grip 26 circumferentially encompassing first end 46 of shaft 14. Generally, grip 26 is preferably made from a resilient material and has a larger diameter than shaft 14 to promote better "feel" and/or control of the putter 10 during play. In one particular preferred embodiment, grip 26 is substantially larger than shaft 14 and is rounded in shape. In another embodiment, grip cap 28 is affixed to grip 26 to prevent undesired marring or premature wear.

As seen in FIGS. 1–3, shaft 14 is located at the center of blade 12 in order to allow any golfer (right or left-handed) the option of using either putting face 16 or chipping face 18 during play without reversing or interchanging any parts.

Various modifications may be made without departing from the scope of the present invention. For example, while putter blade 12 and shaft 14 are preferably made from steel, graphite and/or metal, each may be made from other materials or combination thereof including, but not limited to, aluminum, ceramic, fiberglass, and/or beryllium. Advantageously, the shaft 14 can be constructed of two or more telescopically-adjustable or collapsible members to allow the same to adjust to different lengths for individual golfers.

What is claimed is:

1. A two-faced golf club for right-handed or left-handed golfers, comprising:

a putting blade having a top surface, a bottom surface, a putting face, a chipping face, and a front surface;

said putting blade having a first common edge defining the intersection of said top surface and said putting face, said top surface and said putting face meeting at an angle of at least ninety degrees, and said putting blade having a rear midpoint located at the center of said first common edge;

said putting blade having a second common edge defining the intersection of said top surface and said front surface, and said putting blade having a side midpoint located at the center of said second common edge;

said putting blade having a central point located on said top surface defined by and located at an intersection between a perpendicular line drawn from said rear midpoint across said top surface and a perpendicular line drawn from said side midpoint across said top surface;

a vertically disposed shaft having a first end and a second end, said second end is attached to said central point of said top surface at a right angle; and said putting blade having a third common edge defining the intersection of said top surface and said chipping face, said chipping face comprising an outside angle of at least 130 degrees relative to said vertical shaft.

2. A two-faced golf putter according to claim 1, further comprising:

said putting blade having a forth common edge defining the intersection of said bottom surface and said putting face having a generally rounded disposition; and said putting blade having a fifth common edge defining the intersection of said bottom surface and said chipping face having a generally rounded disposition.

3. A two-faced golf club according to claim 1 wherein said second end of said shaft is removably attached to said putter blade at said central point.

4. A two-faced golf putter according to claim 1, further comprising:

a vertically disposed shaft comprising at least a one inch diameter;

a putter grip circumferentially encompassing said first end of said shaft.

5. A two-faced golf club according to claim 4 wherein the shape of said putter grip is substantially round.

6. A two-faced golf putter according to claim 4 wherein the diameter of said putter grip is about one and one-quarter inches.

7. A two-faced golf club according to claim 1 wherein said shaft comprises a material selected from the group consisting of steel, graphite, ceramic, aluminum and wood.

8. A two-faced golf putter for right-handed or left-handed golfers, comprising:

a generally rectangular putter blade having a top surface, a bottom surface, a putting face, a chipping face, and a front surface;

said putting blade having a first common edge defining the intersection of said top surface and said putting face, said top surface and said putting face meeting at an angle of at least ninety degrees, and said putting blade having a rear midpoint located at center of said first common edge;

said putting blade having a second common edge defining the intersection of said top surface and said front surface, and said putting blade having a side midpoint located at center of said second common edge;

said putter blade having a central point located on said top surface defined by and located at an intersection between a perpendicular line drawn from said rear midpoint across said top surface and a perpendicular line drawn from said side midpoint across said top surface;

a vertically disposed shaft having a first end and a second end, said second end right angularly attached at said central point of said top surface;

said putting blade having a third common edge defining the intersection of said top surface and said chipping face, said chipping face depending from said third common edge and comprising an outside angle of about 160 degrees relative to said vertical shaft;

said putting blade having a forth common edge defining the intersection of said bottom surface and said putting face having a generally rounded disposition; and said putting blade having a fifth common edge defining the intersection of said bottom surface and said chipping face having a generally rounded disposition.

9. A two-faced golf putter according to claim 8, further comprising:

said vertically disposed shaft comprising at least a one inch diameter;

a putter grip circumferentially encompassing and substantially downwardly extending from said first end of said shaft.

10. A two-faced golf putter according to claim 8 wherein said second end of said shaft is removably attached to said putter blade at said central point.

11. A two-faced golf putter for right-handed or left-handed golfers, comprising:

a generally rectangular putter blade having a top surface, a bottom surface, a putting face, a chipping face, and a front surface;

said putting blade having a first common edge defining the intersection of said top surface and said putting face, said top surface and said putting face meeting at an angle of at least ninety degrees, and said putting blade having a rear midpoint located at center of said first common edge;

said putting blade having a second common edge defining the intersection of said top surface and said front surface, and said putting blade having a side midpoint located at center of said second common edge;

said putter blade having a central point located on said top surface defined by and located at an intersection between a perpendicular line drawn from said rear midpoint across said top surface and a perpendicular line drawn from said side midpoint across said top surface;

a vertically disposed shaft having a first end and a second end, said second end right angularly attached at said central point of said top surface;

said putting blade having a third common edge defining the intersection of said top surface and said chipping face, said chipping face depending from said third common edge and comprising an outside angle of at least 130 degrees relative to said vertical shaft;

said putting blade having a forth common edge defining the intersection of said bottom surface and said putting face having a generally rounded disposition;

said putting blade having a fifth common edge defining the intersection of said bottom surface and said chipping face having a generally rounded disposition; and said vertical shaft comprises a material selected from the group consisting of steel, graphite, ceramic, aluminum and wood.

12. A two-faced golf putter according to claim 11, further comprising:

said vertically disposed shaft comprising at least a one inch diameter;

a putter grip circumferentially encompassing and substantially downwardly extending from said first end of said shaft.

13. A two-faced golf putter according to claim 11 wherein said second end of said shaft is removably attached to said putter blade at said central point.

* * * * *